US007980388B2

(12) United States Patent
Dewey

(10) Patent No.: US 7,980,388 B2
(45) Date of Patent: Jul. 19, 2011

(54) GUN BARREL CLEANER

(76) Inventor: George Dewey, Middlebury, CT (US)

( * ) Notice: Subject to any disclaimer, the term of this patent is extended or adjusted under 35 U.S.C. 154(b) by 137 days.

(21) Appl. No.: 12/404,730

(22) Filed: Mar. 16, 2009

(65) Prior Publication Data

US 2010/0155270 A1 Jun. 24, 2010

Related U.S. Application Data

(60) Provisional application No. 61/139,715, filed on Dec. 22, 2008.

(51) Int. Cl.
*B08B 9/00* (2006.01)

(52) U.S. Cl. ..... 206/223; 206/317; 42/95

(58) Field of Classification Search ..... 206/223, 206/317; 42/95; 15/104.05, 104.066, 104.067, 15/104.16, 104.2
See application file for complete search history.

(56) References Cited

U.S. PATENT DOCUMENTS

| | | | | |
|---|---|---|---|---|
| 214,484 | A | 4/1879 | Brown | |
| 363,951 | A | 5/1887 | Forster | |
| 387,410 | A | 8/1888 | Gillette | |
| 882,598 | A | 3/1908 | Ward | |
| 2,544,847 | A * | 3/1951 | Malesky | 15/104.165 |
| 2,834,973 | A | 10/1956 | Friesen | |
| 2,897,525 | A * | 8/1959 | Goodwin et al. | 15/104.165 |
| 3,205,518 | A * | 9/1965 | Romaine | 15/104.165 |
| 3,708,820 | A | 1/1973 | Schultea | |
| 3,716,884 | A * | 2/1973 | Lavins | 15/104.16 |
| 4,050,384 | A * | 9/1977 | Chapman | 104/138.2 |
| 4,399,627 | A * | 8/1983 | Malesky et al. | 42/95 |
| 4,716,673 | A * | 1/1988 | Williams et al. | 42/95 |
| 5,555,588 | A | 9/1996 | Viesehon | |
| 5,588,242 | A * | 12/1996 | Hughes | 42/95 |
| 5,829,088 | A | 11/1998 | Ujihara | |
| 6,088,866 | A | 7/2000 | Hedge | |
| 6,630,034 | B1 | 10/2003 | Schnell | |
| 7,441,363 | B1 | 10/2008 | Black | |

FOREIGN PATENT DOCUMENTS

| | | | |
|---|---|---|---|
| DE | 20100162 | U1 | 3/2001 |
| FR | 002848656 | A1 | 6/2004 |
| ZA | 8005708 | A | 7/1981 |

* cited by examiner

*Primary Examiner* — J. Gregory Pickett
(74) *Attorney, Agent, or Firm* — Michael A. Blake

(57) ABSTRACT

A gun barrel cleaner comprising: a flexible cable, with a cable diameter; a tip attached to a first end of the flexible cable, the tip having a tip diameter; a connector attached to a second end of the flexible cable, the connector having a connector diameter; a generally spherical member in slideable communication with the flexible cable, the generally spherical member having an outer diameter, a bore, with a bore diameter; where the bore diameter is greater than the cable diameter, is less than the tip diameter, and is less than the connector diameter. A gun barrel cleaning kit comprising: a flexible cable, with a cable diameter; a cleaning tip attached to a first end of the flexible cable, the cleaning tip having a tip diameter, and a cleaning patch receiving slot; a connector attached to a second end of the flexible cable, the connector having a connector diameter; a cleaning brush removeably attached to the connector via a threaded engagement; a generally spherical member in slideable communication with the flexible cable, the generally spherical member having an outer diameter, a bore, with a bore diameter; at least one cleaning patch removeably attachable to the cleaning patch receiving slot; an openable and closeable gun barrel cleaning container configured to hold all of the above listed components; and where the bore diameter is greater than the cable diameter, is less than the tip diameter, and is less than the connector diameter.

3 Claims, 2 Drawing Sheets

GUN BARREL CLEANER

CROSS-REFERENCES

This patent application claims the benefit of provisional patent application Ser. No. 61/139,715, by George Dewey, entitled "Gun Barrel Cleaner", filed on Dec. 22, 2008, the entire contents of which are fully incorporated by reference herein.

TECHNICAL FIELD

The present invention relates generally to gun barrel cleaning devices, and more particularly, to a gun barrel cleaner having a flexible cable.

BACKGROUND

Although a firearm is typically cleaned at home, it sometimes is desirable or absolutely necessary to clean a gun barrel in a field, camp, or elsewhere. For example, if a gun barrel bore becomes clogged with mud or snow while a sportsman is hunting, the hunter must for his own safety remove the obstruction from the barrel bore. Often, when a hunter has such a bore obstruction in his gun it is not convenient or expeditious for him to return home for the sole purpose of cleaning the gun barrel. Similarly if a soldier finds that his gun requires cleaning, he may have to clean his gun out in the field, and such cleaning may be during a life or death situation for the soldier.

In the past, most gun barrel cleaning devices comprised an elongated rigid rod having a cleaning brush secured to one end. Such cleaning devices were obviously cumbersome to transport and difficult to store because of their length and rigidity. Another, more effective, approach to producing a less cumbersome product has been to incorporate a flexible cable, with different accessories that are attached to the cable, such accessories may include a T-shaped handle to allow a user to pull the cable through a gun bore, and or different styles and types of cleaning tips. However, a drawback with the above type of cleaning device, is that the more removable pieces there are, the more likely it is to lose pieces, thus leading to delays in cleaning the firearm and or even the inability to properly clean a firearm.

SUMMARY

The disclosed invention relates to a gun barrel cleaner comprising: a flexible cable, with a cable diameter; a tip attached to a first end of the flexible cable, the tip having a tip diameter; a connector attached to a second end of the flexible cable, the connector having a connector diameter; a generally spherical member in slideable communication with the flexible cable, the generally spherical member having an outer diameter, a bore, with a bore diameter; where the bore diameter is greater than the cable diameter, is less than the tip diameter, and is less than the connector diameter.

The disclosed invention also relates to a gun barrel cleaning kit comprising: a flexible cable, with a cable diameter; a cleaning tip attached to a first end of the flexible cable, the cleaning tip having a tip diameter, and a cleaning patch receiving slot; a connector attached to a second end of the flexible cable, the connector having a connector diameter; a cleaning brush removeably attached to the connector via a threaded engagement; a generally spherical member in slideable communication with the flexible cable, the generally spherical member having an outer diameter, a bore, with a bore diameter; at least one cleaning patch removeably attachable to the cleaning patch receiving slot; an openable and closeable gun barrel cleaning container configured to hold all of the above listed components; and where the bore diameter is greater than the cable diameter, is less than the tip diameter, and is less than the connector diameter.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
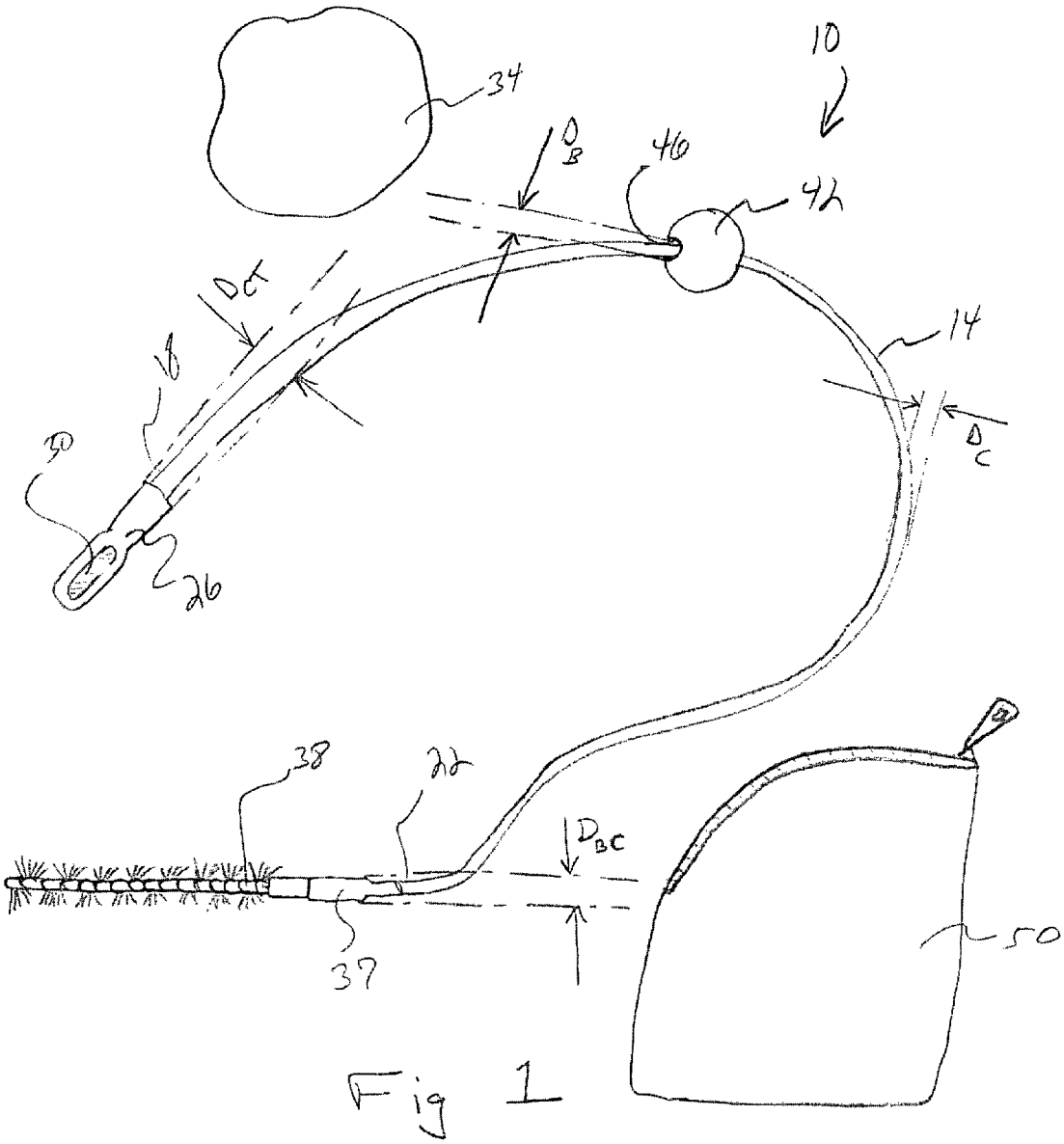
FIG. 1 is a top view of the disclosed gun barrel cleaner.

FIG. 1 shows one embodiment of the disclosed gun barrel cleaner 10. The gun barrel cleaner comprises a cable 14, or flexible shaft. In one embodiment the cable may be about 125 lb to 1200 lb test wire cable wrapped in a nylon covering, or a vinyl covering, but may also be wrapped in any other suitably material, or not wrapped at all. Of course other configurations of cable and flexible shafts may be used. The cable 14 has a first end 18 and a second end 22. Attached to the first end 18 is a cleaning tip 26. The cleaning tip 26 comprises a cleaning patch receiving slot 30. A cleaning patch 34 is shown adjacent to the gun barrel cleaner 10. The cleaning patch 34 may be a piece of material suitable for wiping down a gun barrel, such material may include, but is not limited to cotton fabric, nylon fabric, polyester fabric, silk fabric. The cleaning tip 26 may be permanently affixed to the first end 18, or may be removeably attached via threaded engagement with the first end 18. Attached to the second end 22 is a brush connector 37. A cleaning brush 38 may be removeably attachable to the brush connector 37. The cleaning brush 38 is configured to be pulled through a gun barrel and clean/brush the interior surface area of a gun barrel. The cleaning brush 38 may be a wire brush. A spherical member 42 is slideably attached to the cable 14. In one embodiment, the spherical member 42 may have a diameter of about 0.6 inches. The spherical member may be made out of nylon, plastic, wood, metal, fiberglass, rubber or any other suitable material. The spherical member 42 may have a covering to provide better grip to a user, when pulling the cable 14 through a gun barrel. The spherical member 42 comprises a bore 46 that has a diameter $D_B$ that is greater than the diameter $D_C$ of the cable 14, thus allowing the spherical member 42 to slide up and down the cable 14 until it runs into the cleaning tip 26 or brush connector 37. The cleaning tip 26 and brush connector 37 have diameters $D_{CT}$ and $D_{BC}$ that are greater than the bore 46 diameter $D_B$. In one embodiment, the cable 14 may have a diameter $D_C$ of about 0.12 inches, the bore may have a diameter $D_B$ of about 0.16 inches, and the cleaning tip $D_{CT}$ 26 and/or brush connector may have a diameter $D_{BC}$ of about 0.2 inches. Of course, these diameters may be changed, and still be within the scope of the disclosed invention, especially when configured to clean larger and smaller barrels. An optional gun barrel cleaner container 50 may be included with the disclosed invention. The container 50, in one embodiment, may be a zippered pouch configured to hold the gun barrel cleaner 10 and cleaning patches 34. In other embodiments, the container 50 may also be configured to hold additional and/or different sized cleaning tips, and cleaning brushes, and other items useful for cleaning firearms.

Figure 2:
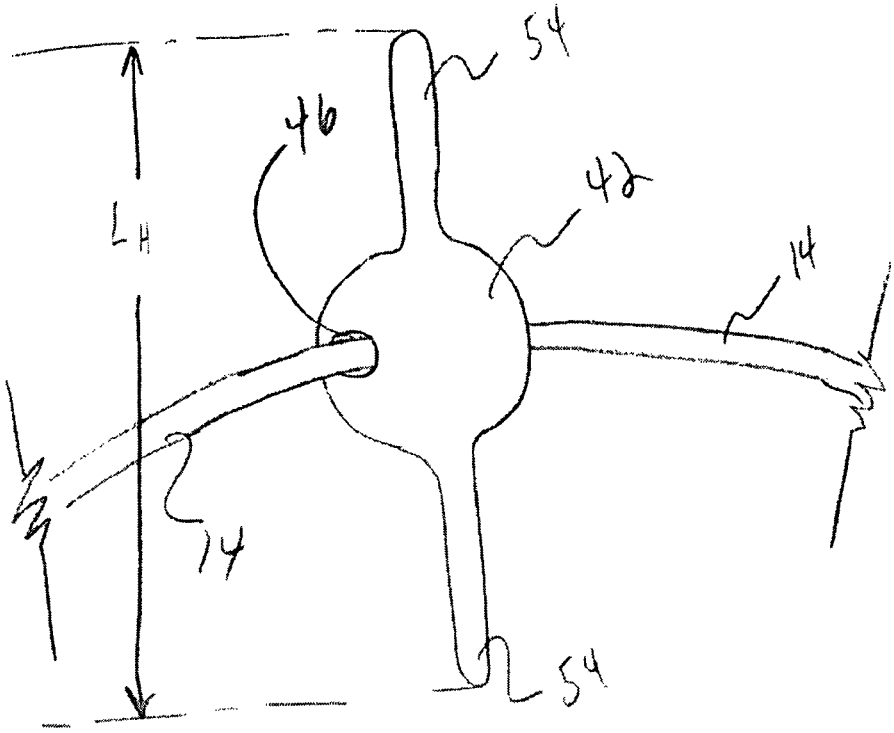
FIG. 2 is a close-up view of another embodiment of the spherical member.
Figure 3:
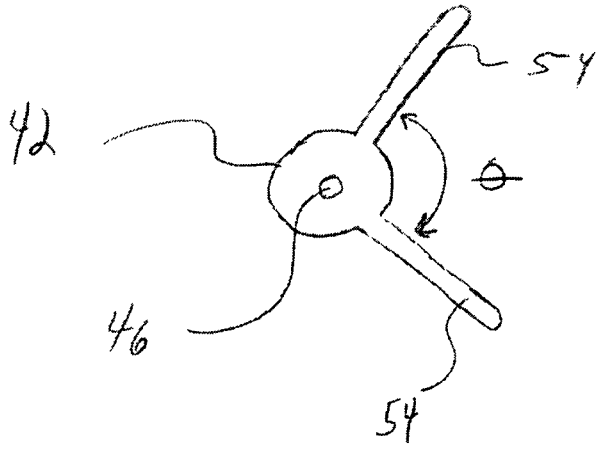
FIG. 3 is a front view of another embodiment of the spherical member.

In another embodiment, the spherical member 42 may have two extending members 54 that form a T-handle, as shown in FIG. 2. The total length $L_H$ of the two extending members 54 may be about 1.8 inches. Of course other lengths may be used. In addition, instead of both extending members 54 generally lying on the same line, the extending members 54 may be at an angle θ with respect to one another, see FIG. 3.

When using the disclosed invention, one may remove the cleaning brush 38 from the brush connector 37. One then can thread the brush connector 37 end of the cable 14 through a gun barrel. Once the brush connector 37 is threaded through the gun barrel, with a portion of the cable in the gun barrel, one can re-attach the cleaning brush 38 to the brush connector 37. Now, one can pull the cable at or near the cleaning tip 26 end, using the spherical member 42 as a hand hold, thus causing the brush 38 to clean the inside of the gun barrel. Alternatively, one may thread the cleaning tip 26 end of the cable 14 through a gun barrel, then attach a cleaning patch 34 to the cleaning tip 26 (via the slot 30). Once the cleaning patch 34 is attached to the cleaning tip, one pulls at or near the second end 22 of the cable 14, using the spherical member 42 as a hand hold. This causes the cleaning patch 34 to wipe down the interior of the gun barrel.

The disclosed invention has many advantages. One advantage is that there is not the need for a separate "T-handle" to attach to the cable 14, thus there is one less piece that can be lost out in the field. The spherical member 42, may be used as the hand hold to pull the cable 14 through a gun barrel. The spherical member 42, is generally permanently attached to the cable 14, and thus cannot be separated from the cable 14, and thus be lost. The spherical member 42 may optionally come with extending members 54, to provide a better hand hold or grip while pulling the cable 14 through a gun barrel.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A gun barrel cleaner comprising:

a flexible cable, with a cable diameter;

a tip attached to a first end of the flexible cable, the tip having a tip diameter, a connector attached to a second end of the flexible cable, the connector having a connector diameter;

a generally spherical member in slideable communication with the flexible cable, the generally spherical member having an outer diameter, a bore, with a bore diameter;

wherein the bore diameter is greater than the cable diameter, is less than the tip diameter, and is less than the connector diameter;

wherein the generally spherical member comprises:

a first extending member extending generally orthogonally from the surface of the generally spherical member; and a second extending member extending generally orthogonally from the surface of the generally spherical member.

2. The gun barrel cleaner of claim 1, wherein the first extending member and the second extending member lie generally on the same imaginary line.

3. The gun barrel cleaner of claim 1, wherein the first extending member forms an acute angle with the second extending member.

* * * * *